US009496123B2

(12) United States Patent
Kholomeev et al.

(10) Patent No.: US 9,496,123 B2
(45) Date of Patent: Nov. 15, 2016

(54) ION DETECTION

(71) Applicant: Thermo Fisher Scientific (Bremen) GmbH, Bremen (DE)

(72) Inventors: Alexander Kholomeev, Bremen (DE); Alexander Alekseevich Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/161,850

(22) Filed: May 23, 2016

(65) Prior Publication Data

US 2016/0268118 A1 Sep. 15, 2016

Related U.S. Application Data

(62) Division of application No. 14/117,302, filed as application No. PCT/EP2012/058938 on May 14, 2012, now Pat. No. 9,349,579.

(30) Foreign Application Priority Data

May 12, 2011 (GB) ..... 1107958.9

(51) Int. Cl.
*H01J 49/02* (2006.01)

(52) U.S. Cl.
CPC ..... *H01J 49/025* (2013.01)

(58) Field of Classification Search
USPC ..... 250/283, 281, 282, 397
See application file for complete search history.

(56) References Cited

U.S. PATENT DOCUMENTS

| | | | | |
|---|---|---|---|---|
| 3,725,804 | A | 4/1973 | Langan | |
| 7,714,283 | B2 | 5/2010 | Makarov et al. | |
| 2004/0169137 | A1* | 9/2004 | Westphall | H01J 49/06 250/281 |
| 2009/0294654 | A1* | 12/2009 | Steiner | H01J 49/025 250/283 |
| 2010/0181475 | A1* | 7/2010 | Makarov | H01J 49/425 250/294 |
| 2013/0068942 | A1 | 3/2013 | Verentchikov | |

FOREIGN PATENT DOCUMENTS

| | | | |
|---|---|---|---|
| DE | 112006001716 | T | 5/2008 |
| GB | 2402260 | A | 12/2004 |
| GB | 2434484 | A | 7/2007 |
| JP | 05-69631 | U1 | 9/1993 |
| WO | 9310553 | A1 | 5/1993 |
| WO | 03048789 | A2 | 6/2003 |
| WO | 2006129109 | A2 | 12/2006 |
| WO | 2007000587 | A2 | 1/2007 |
| WO | 2008119166 | A1 | 10/2008 |

* cited by examiner

*Primary Examiner* — Kiet T Nguyen
(74) *Attorney, Agent, or Firm* — David A. Schell

(57) ABSTRACT

A mass analyzer in which ions form packets that oscillate with a period has an ion detector comprising: a detection arrangement; and compensation circuitry. The detection arrangement may comprise: a plurality of detection electrodes detecting image current signals from ions in the mass analyzer; and a preamplifier, providing an output based on the image current signals. The compensation circuitry provides a compensation signal to a respective compensatory part of the detection arrangement, based on one or more of the image current signals. A capacitance between each of the compensatory parts of the detection arrangement and a signal-carrying part of the detection arrangement affects the signal-to-noise ratio of the preamplifier output. A generator may provide a trapping field defining an ion trapping volume and a shielding conductor may be positioned between two detection electrodes, with a controller applying a voltage to the shielding conductor based on a detected image current.

8 Claims, 9 Drawing Sheets

ION DETECTION

CROSS-REFERENCE TO RELATED APPLICATION

This application is a divisional under 35 U.S.C. §121 and claims the priority benefit of co-pending U.S. patent application Ser. No. 14/117,302, filed Nov. 12, 2013, which is the United States National Stage Application, under 35 U.S.C. 371, of International Application PCT/EP2012/058938 having an international filing date of May 14, 2012. The disclosures of each of the foregoing applications are incorporated herein by reference.

TECHNICAL FIELD OF THE INVENTION

The present invention concerns ion detection for a mass analyser in which ions are caused to form ion packets that oscillate with a period, including a ion detector and a method of ion detection. Such a mass analyser may include an Fourier Transform Ion Cyclotron Resonance (FTICR) mass analyser, an electrostatic orbital trapping mass analyser or any other ion trap with image current detection.

BACKGROUND TO THE INVENTION

For Fourier Transform Mass Spectrometry (FTMS), the detection limit of mass-to-charge (m/z) ratio analysis has been defined in Marshall, A. G., Hendrickson C. L., "Fourier Transform Ion Cyclotron Resonance Detection: Principles and Experimental Configurations", Int. J. Mass Spectrom. 2002, 215, 59-75. There, the detection limit is considered the minimum number of ions, M, of charge q detected with signal-to-noise ratio 3:1. This detection limit has been shown as proportional to the voltage noise of an input transistor of the pre-amplifier ($V_n$), the capacitance of the detection circuit ($C_{det}$) and inversely proportional to the relative amplitude of detected oscillations, A. In other words, $$M = const\frac{C_{det}V_n}{qA}$$

The voltage noise is determined by the process of semiconductor manufacturing and improvement here is limited. Also, the relative amplitude of detected oscillations is limited by the quality of the trapping field and improvement here is also difficult (for example, in practical electrostatic orbital trapping analyzers, A is close to 60-700). Therefore, an improvement to the detection limit is likely to be achieved by reducing the capacitance of the detection circuit, $C_{det}$.

WO-2008/103970 shows a wideband pre-amplifier for FTMS. However, in this design, it is suggested that the signal-to-noise ratio is optimised when the input capacitance of the JFET transistor in the pre-amplifier is equal to the sum of the wiring capacitance and the capacitance of the detection plate. This is a different approach than the reduction in capacitance suggested above.

Reduction of the parasitic capacitance in mass analysers is typically implemented via passive measures, for instance by separating detection electrodes, reducing their size or making wires as short and thin as possible. All these methods provide only an incremental improvement. It is desirable to provide a significant reduction of multiple sources of capacitance using another method.

SUMMARY OF THE INVENTION

Against this background, there is provided an ion detector for a mass analyser in which ions are caused to form ion packets that oscillate with a period. The ion detector comprises: a detection arrangement, comprising: a plurality of detection electrodes configured to detect a plurality of image current signals from ions in the mass analyser; and a preamplifier, wherein the preamplifier is arranged to provide an output signal based on the plurality of detected image current signals, the output signal having a signal-to-noise ratio; and compensation circuitry, arranged to provide at least one compensation signal, each compensation signal being provided to a respective compensatory part of the detection arrangement and being based on one or more of the plurality of detected image current signals. There is a capacitance between each of the compensatory parts of the detection arrangement and a respective signal-carrying part of the detection arrangement, affecting the signal-to-noise ratio of the preamplifier output signal.

The compensation circuitry thereby causes a reduction in the capacitance between each compensatory part of the detection arrangement and its respective signal carrying part of the detection arrangement. This reduction is from the value that it would otherwise be were the compensation circuitry not present.

In other words, the capacitance between each of the compensatory parts of the detection arrangement and the respective signal-carrying part of the detection arrangement is defined when the compensation signal is not applied. However, when each compensation signal is applied, it compensates for the respective capacitance of the detection arrangement, affecting the signal-to-noise ratio of the preamplifier output signal. The capacitance between each of the compensatory parts of the detection arrangement and the respective signal-carrying part of the detection arrangement when the compensation signal is applied is reduced in comparison with the capacitance when the compensation signal is not applied. In fact, between a compensatory parts of the detection arrangement and a signal-carrying part of the detection arrangement when the compensation signal is applied may be effectively or substantially zero.

Advantageously, the compensation signal applied to the compensatory part of the detection arrangement is based on a signal carried by the respective signal-carrying part of the detection arrangement. Preferably, the difference in signal amplitude between the ac part of the compensation signal and the ac part of the signal carried by the respective signal-carrying part is relatively small in comparison with the signal amplitude of the ac part of the signal carried by the respective signal-carrying part. Optionally, the difference in signal amplitude of the ac part is no more than 10%, 5%, 2.5%, 1% or 0.5%. Beneficially, the difference in phase between the compensation signal and the signal carried by the respective signal-carrying part is small. Optionally, the difference in phase is less than 90 degrees, 45 degrees, 30 degrees, 15 degrees, 10 degrees, 5 degrees or 1 degree.

In one embodiment, the signal-carrying part of the detection arrangement comprises a detection electrode from the plurality of detection electrodes and the respective compensatory part of the detection arrangement comprises a shield for the detection electrode. The respective compensation signal may be provided to the shield to cause effectively zero capacitance between the shield and the detection electrode.

Here, the shield may be adjacent to the detection electrode. Preferably, the shield for the detection electrode comprises a conductive surface around the detection electrode, insulated from the detection electrode. More preferably, the shield for the detection electrode is made from a dielectric material, preferably glass, with metallised outer and inner coatings, the metallised inner coating being configured to detect the ion signal and the metallised outer coating being configured to receive the compensation signal. This arrangement is particularly advantageous for electrostatic orbital trapping-type mass analysers, for example of the type described in U.S. Pat. No. 5,886,346 and available under the trade name Orbitrap.

Additionally or alternatively, a signal-carrying part of the detection arrangement may comprise a connection, such as a wire, between a detection electrode from the plurality of detection electrodes and the preamplifier and the respective compensatory part of the detection arrangement may comprise a shield for the connection. The respective compensation signal may be provided to the shield to cause effectively zero capacitance between the shield and the connection. The shield for the detection electrode and the shield for the connection may be electrically connected. Then, a single common compensation signal may be provided to both the shield for the detection electrode and shield for the connection.

In the preferred embodiment, the preamplifier comprises a first voltage buffer arranged to receive a first image current signal from the plurality of image current signals. In such an embodiment, the compensation circuitry may be arranged to provide a first compensation signal, comprising an output of the first voltage buffer. In this way, the first compensation signal is based on the first image current signal. The first voltage buffer may provide a low output impedance. Preferably, the first voltage buffer comprises a transistor, most preferably a low-noise JFET with the lowest possible gate capacitance and the highest possible transconductance.

In some embodiments, the compensation circuitry is further arranged to provide a second compensation signal, based on a second image current signal from the plurality of detected image current signals. The second compensation signal may be provided to a second compensatory part of the detection arrangement, there being a capacitance between the second compensatory part of the detection arrangement and a respective, second signal-carrying part of the detection arrangement affecting the signal-to-noise ratio of the preamplifier output signal. Here, the preamplifier may further comprise a second voltage buffer, arranged to receive the second image current signal, the second compensation signal comprising an output of the second voltage buffer. Again, the second voltage buffer may provide a low output impedance. Preferably, the second voltage buffer comprises a transistor, most preferably a low-noise JFET with the lowest possible gate capacitance and the highest possible transconductance. Optionally for this arrangement, the first signal-carrying part of the detection arrangement comprises a first detection electrode, the respective compensatory part comprising a first shield for the first detection electrode. This reduces the capacitance between the first detection electrode and ground. Also, the second signal-carrying part may comprise a second detection electrode, the respective compensatory part comprising a second shield for the second detection electrode. This reduces the capacitance between the second detection electrode and ground.

Optionally, the first voltage buffer may comprise a transistor in a common drain configuration. Then, the compensation circuitry may be further arranged to provide a drain compensation signal to the drain of the transistor. This may reduce the effective capacitance between the gate and drain of the transistor. In some cases, the compensation circuitry is arranged to provide a second compensation signal to a second compensatory part of the detection arrangement and the preamplifier comprises a second voltage buffer, arranged to receive the second image current signal, the second compensation signal comprising an output of the second voltage buffer. In such cases, the preamplifier may further comprise a differential amplifier arranged to receive the output of the first voltage buffer and the output of the second voltage buffer and to provide a differential output, the differential amplifier preferably being further configured to provide the drain compensation signal. Optionally, the drain compensation signal is based on the second image current signal, especially in the case of symmetrical differential input signals.

Optionally, the compensation signal could be provided in a more conventional way, that is using a cascade configuration of the input buffer. This means that an additional transistor in the input buffer is connected in series in common base (or gate) configuration with the drain of the input follower, wherein base (or gate) of the common base (or gate) transistor is DC-coupled or AC-coupled to the output of the input buffer. Therefore, this may make the use of the second signal output unnecessary for providing a compensation signal.

Preferably, the differential amplifier comprises a first amplifier transistor arranged to receive the output of the first voltage buffer and a second amplifier transistor arranged to receive the output of the second voltage buffer, the first and second amplifier transistors being arranged as a differential pair. The drain compensation signal may be provided from a signal at the drain of the second amplifier transistor. Optionally, the drain compensation signal is a first drain compensation signal provided to the drain of the transistor of the first voltage buffer and the second voltage buffer may comprise a transistor in a common drain configuration. Then, the at least one compensation signal may further comprise a second drain compensation signal provided to the drain of the transistor of the second voltage buffer, the second drain compensation signal being provided from a signal at the drain of the first amplifier transistor. This may reduce the capacitance between the gate and drain of the transistor.

In the preferred embodiment, the compensation circuitry is arranged to provide a first shield compensation signal to a first shield compensatory part of the detection arrangement and a second shield compensation signal to a second shield compensatory part of the detection arrangement. Then, the first shield compensation signal and the second shield compensation signal may be the same. Optionally, the first shield compensatory part may comprise a shield for a first detection electrode from the plurality of detection electrodes and the second shield compensatory part may comprise a shield for a connection between the first detection electrode and the preamplifier.

Alternatively, the first shield compensatory part may comprise a shield for a second detection electrode from the plurality of detection electrodes and the second shield compensatory part may comprise a shield for a connection between the second detection electrode and the preamplifier. Advantageously, compensation signals for the shield for the first detection electrode, the shield for the second detection electrode, the shield for a connection between the first detection electrode and the preamplifier and the shield for a connection between the second detection electrode and the preamplifier are provided.

A further advantageous feature of the ion detector may be a shielding conductor, positioned between a first detection electrode and a second detection electrode from the plurality of detection electrodes and configured to be connected to a voltage source, which is preferably external. The voltage source optionally provides a fixed voltage. This reduces the capacitance between the first detection electrode and the second detection electrode. Optionally, the voltage source is configured to provide a voltage to the shielding conductor based on the image current detected by at least one of the plurality of detection electrodes so as to compensate for a change in frequency of oscillation for ions confined in the ion trapping volume caused by space charge.

Beneficially, the pre-amplifier may comprise a differential amplifier comprising a plurality of amplifier transistor pairs. Here, each amplifier transistor pair may comprise: a respective first amplifier transistor arranged to receive a signal based on a first image current signal; and a respective second amplifier transistor arranged to receive a signal based on a second image current signal. Then, the respective first and second amplifier transistor of each amplifier transistor pair may be arranged as a differential pair and the plurality of amplifier transistor pairs may be arranged in parallel. This reduces the overall power spectral density of noise generated by the plurality of amplifier transistor pairs in comparison with the case where only one amplifier transistor pair is used.

The present invention also provides a mass spectrometer comprising a mass analyser and the ion detector as described herein.

There is provided, in an associated aspect of the present invention a method of ion detection for a mass analyser in which ions are caused to form ion packets that oscillate with a period. The method comprises: detecting a plurality of image current signals using a plurality of detection electrodes that form part of a detection arrangement, the detection arrangement further comprising a preamplifier, wherein the preamplifier is arranged to provide an output signal based on the plurality of detected image current signals, the output signal having a signal-to-noise ratio; and providing at least one compensation signal, each compensation signal being provided to a respective compensatory part of the detection arrangement and being based on one or more of the plurality of detected image current signals. There is a capacitance between each of the compensatory parts of the detection arrangement and a respective signal-carrying part of the detection arrangement, affecting the signal-to-noise ratio of the preamplifier output signal.

Alternatively, a method of ion detection for a mass analyser in which ions are caused to form ion packets that oscillate with a period can be described. The method comprises: detecting a plurality of image current signals using a plurality of detection electrodes that form part of a detection arrangement, the detection arrangement further comprising a preamplifier, wherein the preamplifier is arranged to provide an output signal based on the plurality of detected image current signals, the output signal having a signal-to-noise ratio; and providing at least one compensation signal, each compensation signal being provided to a respective compensatory part of the detection arrangement to compensate for a respective capacitance of the detection arrangement, affecting the signal-to-noise ratio of the preamplifier output signal. Preferably, each compensation signal is based on one or more of the plurality of detected image current signals.

Preferably, a signal-carrying part of the detection arrangement comprises a detection electrode from the plurality of detection electrodes and the respective compensatory part of the detection arrangement comprises a shield for the detection electrode. More preferably, the shield for the detection electrode comprises a conductive surface around the detection electrode, insulated from the detection electrode.

Additionally or alternatively, a signal-carrying part of the detection arrangement comprises a connection between a detection electrode from the plurality of detection electrodes and the preamplifier and the respective compensatory part of the detection arrangement comprises a shield for the connection.

In some embodiments, the preamplifier comprises a first transistor voltage buffer arranged to receive a first image current signal from the plurality of image current signals and the at least one compensation signal comprises a first compensation signal, comprising an output of the first transistor voltage buffer. In this way, the first compensation signal is based on the first image current signal. Optionally, the at least one compensation signal further comprises a second compensation signal, based on a second image current signal from the plurality of detected image current signals, the second compensation signal being provided to a second compensatory part of the detection arrangement, there being a capacitance between the second compensatory part of the detection arrangement and a respective, second signal-carrying part of the detection arrangement affecting the signal-to-noise ratio of the preamplifier output signal. Then, the preamplifier may further comprise a second transistor voltage buffer, arranged to receive the second image current signal, the second compensation signal comprising an output of the second transistor voltage buffer. In one embodiment, a first signal-carrying part of the detection arrangement comprises a first detection electrode, the respective compensatory part comprising a first shield for the first detection electrode and the second signal-carrying part comprises a second detection electrode, the respective compensatory part comprising a second shield for the second detection electrode.

In some embodiments, the first voltage buffer comprises a transistor in a common drain configuration and wherein the at least one compensation signal further comprises a drain compensation signal provided to the drain of the transistor.

Then, the method optionally further comprises: receiving the output of the first transistor voltage buffer and the output of the second transistor voltage buffer at a differential amplifier in the pre-amplifier; and providing a differential output from the differential amplifier. Then, the step of providing at least one compensation signal may comprise providing the drain compensation signal from the differential amplifier. Here, the drain compensation signal may be based on the second image current signal.

Preferably, the differential amplifier comprises a first amplifier transistor arranged to receive the output of the first transistor voltage buffer and a second amplifier transistor arranged to receive the output of the second transistor voltage buffer, the first and second amplifier transistors being arranged as a differential pair. Preferably, the drain compensation signal is provided from a signal at the drain of the second amplifier transistor. Optionally, the drain compensation signal is a first drain compensation signal, the second voltage buffer comprising a transistor in a common drain configuration and the at least one compensation signal further comprises a second drain compensation signal provided to the drain of the transistor of the second voltage buffer. Then, the second drain compensation signal may be provided from a signal at the drain of the first amplifier transistor. This may reduce the capacitance between the gate and drain of the transistor.

In some embodiments, the at least one compensation signal comprises: a first shield compensation signal provided to a first shield compensatory part of the detection arrangement; and a second shield compensation signal provided to a second shield compensatory part of the detection arrangement. Then, the first shield compensation signal and the second shield compensation signal are preferably the same. The first shield compensatory part may comprise a shield for a first detection electrode from the plurality of detection electrodes and the second shield compensatory part may comprise a shield for a connection between the first detection electrode and the preamplifier.

In the preferred embodiment, the method further comprises providing a shielding conductor coupled to a voltage positioned between a first detection electrode and a second detection electrode from the plurality of detection electrodes.

Also in the preferred embodiment, the pre-amplifier may comprise a differential amplifier comprising a plurality of amplifier transistor pairs, each amplifier transistor pair comprising: a respective first amplifier transistor arranged to receive a signal based on a first image current signal; and a respective second amplifier transistor arranged to receive a signal based on a second image current signal, the respective first and second amplifier transistor of each amplifier transistor pair being arranged as a differential pair and wherein the plurality of amplifier transistor pairs are arranged in parallel.

In another aspect, the present invention provides an electrostatic ion trapping device comprising: a trapping field generator, configured to provide a trapping field define an ion trapping volume, in which ions are confined; a detection arrangement, configured to detect an image current from ions trapped in the ion trapping volume, using a plurality of detection electrodes; a shielding conductor, positioned between a first detection electrode and a second detection electrode from the plurality of detection electrodes; and a controller, configured to apply a voltage to the shielding conductor based on an image current detected by at least one of the plurality of detection electrodes.

This electrostatic ion trapping device (optionally, an electrostatic orbital trapping-type device) advantageously comprises a shielding conductor between a first detection electrode and a second detection electrode, which reduces the capacitance between these two electrodes. Preferably, the ion trapping device defines an axis and the shielding conductor is between the first and second detection electrodes along this axis. More preferably, the trapping field generator is configured to confine ions so as to cause the ions to oscillate along the axis. The axis is optionally longitudinal. Beneficially, the controller is configured to apply an AC voltage to the shielding conductor.

Moreover, the shielding conductor provides a different benefit from the compensation circuitry described above. At large ion numbers, the oscillation frequency of the ions shifts, due largely to image charges induced in all electrodes by moving ions. By modulating the voltage induced an electrode in-phase or out of phase with the detected image current signal, this effect is cancelled out, improving mass accuracy and dynamic range of analysis.

Advantageously, the controller is configured to apply the voltage to the shielding conductor based on the image current detected by at least one of the plurality of detection electrodes so as to compensate for a change in frequency of oscillation for ions confined in the ion trapping volume caused by space charge. It may be understood that the ion trapping volume defines the axis and that the frequency of oscillation relates to axial oscillation.

Optionally, the trapping field generator comprises an inner electrode arranged along the axis and the electrostatic ion trapping device further comprises first and second outer electrodes, positioned along the axis concentric with the inner electrode to enclose the inner electrode and to define a space between the inner electrode and outer electrodes, said space defining the ion trapping volume. In embodiments, the plurality of detection electrodes comprise one or more of: the inner electrode; the first outer electrode; and the second outer electrode.

Preferably, the first detection electrode is the first outer electrode and the second detection electrode is the second outer electrode. Alternatively, one of the detection electrodes may comprise the inner electrode. Also, more than one inner electrode can optionally be provided. In some such cases, the first detection electrode may be a first inner electrode. Optionally, the second detection electrode may be a second inner electrode.

In some embodiments, the shielding conductor comprises a ring concentric with the inner electrode. Additionally or alternatively, the shielding conductor may comprise a segment formed at a central part (along the axis) of the inner electrode.

Preferably, the shielding conductor is located to avoid significant coupling of AC signal from the detection electrodes. This avoids too great an attractive force towards the shielding conductor.

In a further aspect, there is provided a method of electrostatic ion trapping comprising: causing ions to be trapped in an ion trapping volume; and detecting an image current from ions trapped in the ion trapping volume using a plurality of detection electrodes; providing a shielding conductor, positioned between a first detection electrode and a second detection electrode from the plurality of detection electrodes; and applying a voltage to the shielding conductor based on an image current detected by at least one of the plurality of detection electrodes. This method can optionally further comprise additional features to mirror those defined in respect of the corresponding electrostatic ion trapping device defined herein.

It will also be understood that the present invention is not limited to the specific combinations of features explicitly disclosed, but also any combination of features that are described independently and which the skilled person could implement together.

BRIEF DESCRIPTION OF THE DRAWINGS

The invention may be put into practice in various ways, one of which will now be described by way of example only and with reference to the accompanying drawings in which.

DETAILED DESCRIPTION OF PREFERRED EMBODIMENTS

Figure 1:
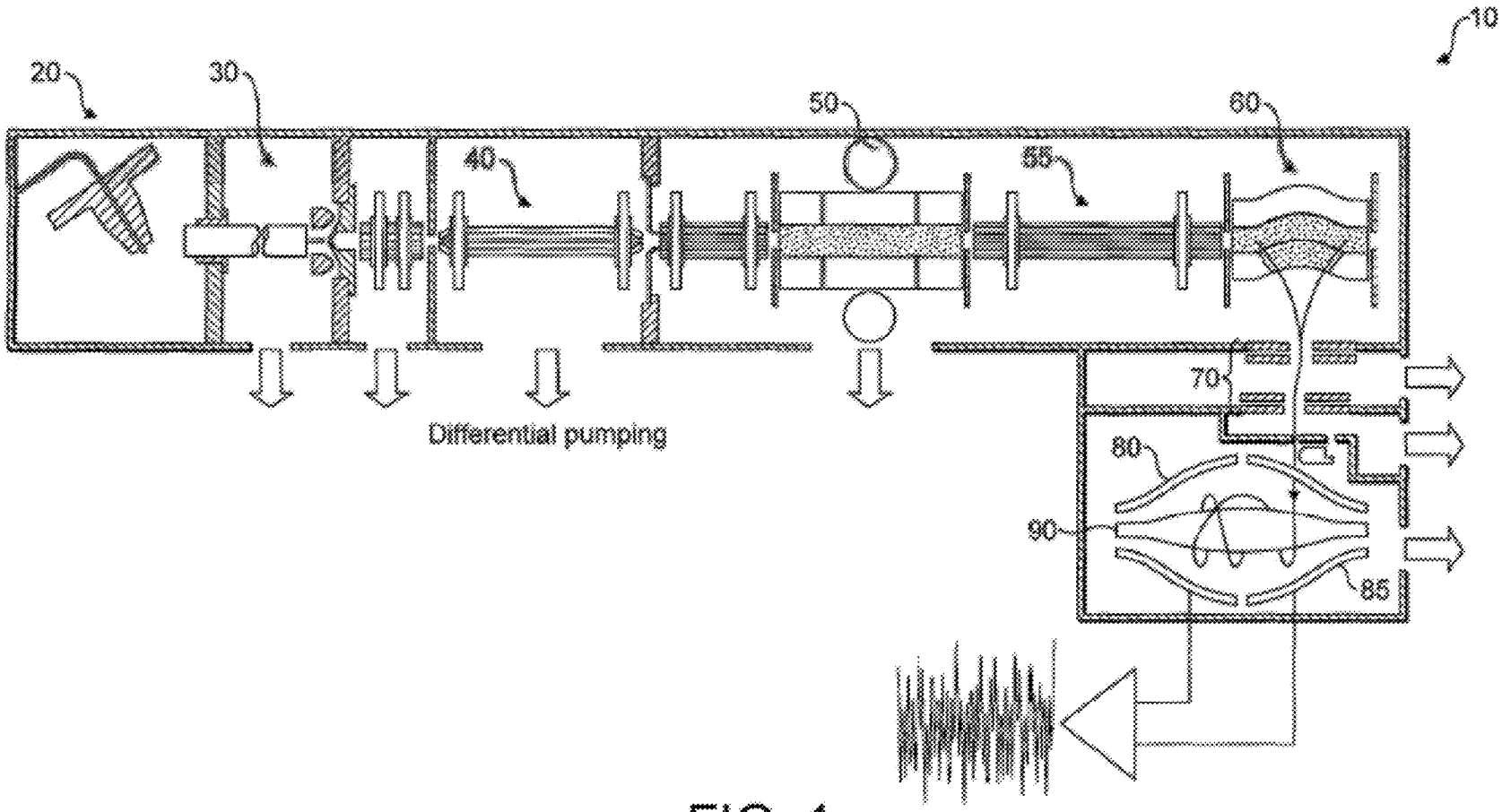
FIG. 1 shows a schematic arrangement of an existing mass spectrometer including an electrostatic trap mass analyser and an external storage device.

Referring first to FIG. 1, a schematic arrangement of an existing mass spectrometer including an electrostatic trap and an external storage device is shown. The arrangement of FIG. 1 is described in detail in commonly assigned WO-A-02/078046 and WO-A-2006/129109 and will not be described in detail here. More details regarding this arrangement can be found in these two documents, the contents of which are incorporated by reference herein.

FIG. 1 is included in order better to understand the use and purpose of the electrostatic trap mass analyser. Although the present invention is described in relation to such an electrostatic trap mass analyser, it will be appreciated that it can also be applied to other kinds of electrostatic trap mass analyser, employing image current detection or an electrostatic field causing ions to form ion packets that oscillate with a period, such as a Fourier Transform Ion Cyclotron Resonance (FTICR) mass analyser.

As seen in FIG. 1, the mass spectrometer 10 comprises: a continuous or pulsed ion source 20; an ion source block 30; an RF transmission device 40 for cooling ions; a linear ion trap mass filter 50; a transfer octapole device 55; a curved linear trap 60 for storing ions; a deflection lens arrangement 70; the electrostatic trap 75, which is the electrostatic orbital trapping-type of mass analyser (as sold by Thermo Fisher Scientific under the trade name Orbitrap) comprising a split outer electrode (comprising first electrode 80 and second electrode 85) and an inner electrode 90. There may also be an optional secondary electron multiplier (not shown), on the optical axis of the ion beam.

Figure 2:
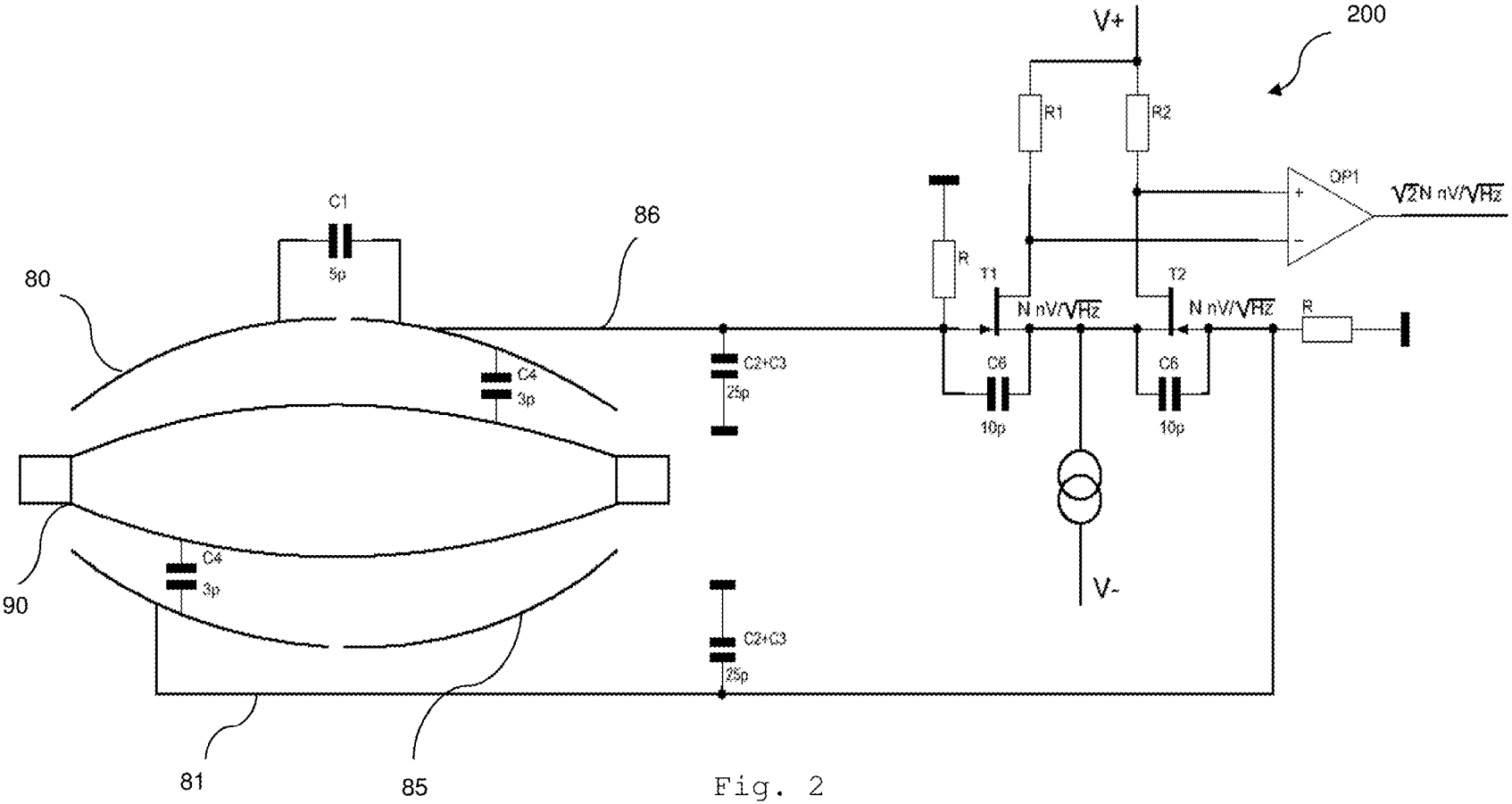
FIG. 2 shows the existing electrostatic trap mass analyser of FIG. 1 in more detail, together with existing detection circuitry.

Referring now to FIG. 2, there is shown the existing electrostatic trap mass analyser of FIG. 1 in more detail, together with existing detection circuitry. An image current is detected using a differential amplifier on the first outer electrode 80 and second outer electrode 85 of the trap as shown on FIG. 2. The first outer electrode 80 and second outer electrode 85 are referred to as detection electrodes. First conductor 81 and second conductor 86 carry a first image current signal and a second image current signal respectively to pre-amplifier 200.

The pre-amplifier 200 comprises: a first amplifier transistor T2; and a second amplifier transistor T1; first resistor R1; second resistor R2; and an operational amplifier OP1. The first amplifier transistor T2 and the second amplifier transistor T1 are connected as a differential pair, together with first resistor R1 and second resistor R2 and a constant current source forming a differential amplifier.

FIG. 2 also schematically depicts a variety of partial, parasitic capacitances, the interaction of which causes an overall capacitance for the detection circuit. Some parasitic resistances are also shown for completeness. The overall capacitance for the detection circuit, $C_{det}$, is a combination of the following partial capacitances (typical values for a standard electrostatic orbital trapping analyzer are presented in brackets):

1. capacitance between first outer electrode 80 and second outer electrode 85 (C1=5 pF, estimated);
2. capacitance between each detection electrode and ground (C2=20 pF);
3. capacitance between conductors (wires) leading from each detection electrode to the pre-amplifier and ground (C3=5 pF);
4. capacitance between each detection electrode and the central electrode 90 (C4=3 pF);
5. capacitance between each detection electrode to other electrodes, for example to deflection lens arrangement 70 (C5=3 pF); and
6. gate-drain capacitance of the first input transistor T2 of the pre-amplifier and gate-drain capacitance of the second input transistor T1 of the pre-amplifier (C6=10 pF).

For the exemplified capacitance values above, the overall capacitance of the detection arrangement, including the detector electrodes and pre-amplifier is given by $$C_{det}=C1+0.5*(C2+C3+C4+C5+C6).$$

Based on the typical, estimated values given above, $C_{det}$=25.5 pF.

The first amplifier transistor T2 and second amplifier transistor T1 are typically JFET transistors. A single JFET transistor has a spectral noise density, N (normally measured in nV/√Hz) and a typical value is 0.85 nV/√Hz. The overall noise density of the differential input stage is given by √2*N. Thus, the signal-to-noise ratio (S/N) of the arrangement shown in FIG. 2 is proportional to $$S/N \propto 1/(C_{det}*\sqrt{2}*N)$$

It will be appreciated that increasing the signal-to-noise ratio by decreasing $C_{det}$ also results in an improvement in the detection limit, M, identified above. If the signal-to-noise ratio is increased by reducing $C_{det}$, then conversely, the number of ions needed to achieve the same signal-to-noise ratio is reduced.

Figure 3:
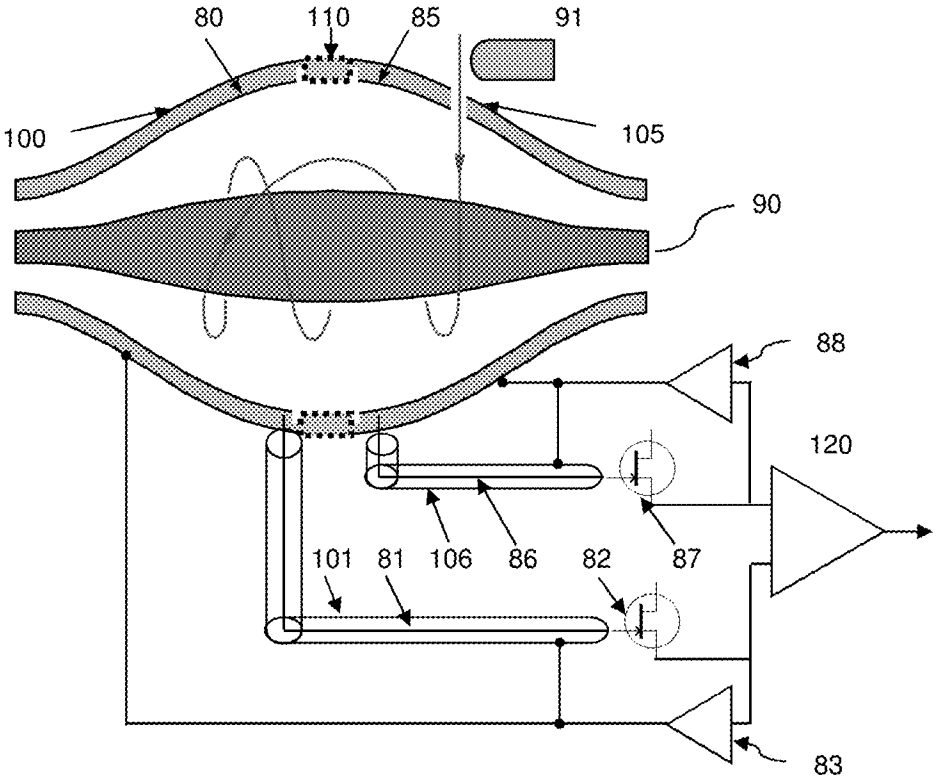
FIG. 3 illustrates a first embodiment of an ion detection arrangement according to the present invention.

Referring next to FIG. 3, a first embodiment of an ion detection arrangement according to the present invention is shown. The embodiment shown in FIG. 3 is based on that of FIG. 2, but with a number of significant changes. This embodiment exemplifies a way of detecting the image current signals. Features that are the same as those shown in FIG. 1 or 2 are identified by identical reference numerals.

In this case, outer electrodes 80 and 85 are made preferably from a clear or high-ohmic glass with a low temperature expansion coefficient. It is metallised (that is, metal coated) in such a way that the outer coating is not connected to the inner coating forming electrodes 80 and 85 but forms a first conductive surface 100 and a second conductive surface 105, each surrounding electrodes 80 and 85, correspondingly and thereby acting as shields. These surfaces 100, 105 could have a gap between them or, optionally, this gap could be covered by a high-ohmic resistive layer 110 (total resistance preferably above 1 MOhm and more preferably above 10 MOhm). Preferably, these surfaces also have a connection to the inner surface of the glass form (not shown) and form a barrier between electrodes 80 and 85.

First conductor (wire) 81 and second conductor (wire) 86 from first detection electrode 80 and second detection electrode 85 connect these electrodes to the first stage of buffering or amplification formed by FET transistors 82 and 87 respectively. These wires are surrounded by first conductive shield 101 and second conductive shield 106 which are also electrically connected to conductive surfaces 100 and 105 respectively. However, the conductive shields 101 and 106 for the connections need not be electrically connected to conductive surfaces 100 and 105 in cases where the conductive surfaces 100 and 105 have their own connections to the compensation signal.

As signals from electrodes 80 and 85 gets amplified by FET transistors 82 and 87, they get de-coupled from the incoming signals and could be used for differential amplification by amplifier 120, but also for active compensation. For the latter, first repeater (buffer or amplifier) 83 and second repeater (buffer or amplifier) 88 feed the signals back to shields 101 and 106 and conductive surfaces 100 and 105. In this way, the total attenuation of incoming signal is exactly (or close to) unity.

Thus, no voltage difference is formed between electrodes 80, 85 and the corresponding conductive surfaces (acting as shields) 100 and 105. This is because the potential difference between the first electrode 80 and the first conductive surface 100 is minimised, such that the capacitance between them is effectively nullified. The same applies to the second electrode 85 and the second conductive surface 105. By extension, this also applies to first conductor 81 and first shield 101 and second conductor 86 and second shield 106. This approach allows reduction in C2, C3, C5 to substantially zero. In addition, C1 could be decreased if a barrier between the first electrode 80 and second electrode 85 is provided as described above. WO-03/048789 provides some information on a general capacitance compensation approach in some ways similar to the compensation used here, as applied to electrodynamic sensors for medical applications.

In practice, the finite response time of first FET 82, second FET 87, first repeater 83 and second repeater 88 results in the appearance of a small phase shift between the image current signals detected by the electrodes and the active compensation signals. However, for the frequency range typically of interest (200-2000 kHz), this phase shift will be only a few degrees. This will not prevent a reduction in C2, C3, C5 by at least a factor of 5 to 10.

Figure 4:
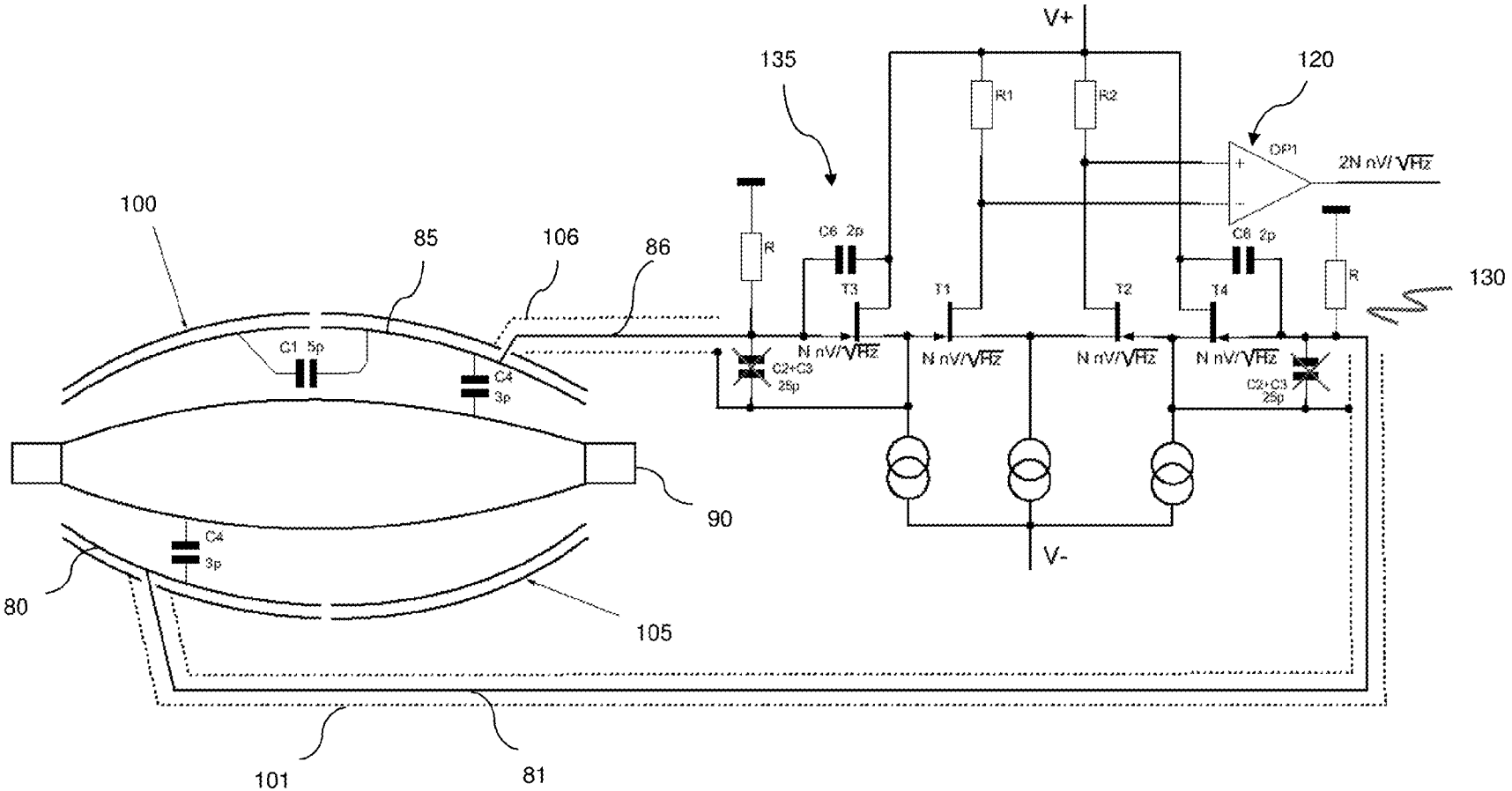
FIG. 4 shows a schematic illustration of the ion detection arrangement embodiment shown in FIG. 3 with additional details.

Referring next to FIG. 4, there is shown a schematic illustration of the embodiment shown in FIG. 3 with additional details. The parasitic capacitances and resistances that were shown in FIG. 2 are also shown in this drawing. The capacitances between each of the detection electrodes and ground and between the conductors (wires) and ground (C2+C3) and the capacitance between input to the pre-amplifier and ground (C6) now provide the greatest contributions towards $C_{det}$. In addition to the shields 100, 105 and 101, 106, further active shielding is implemented by providing additional buffer amplifiers using a first buffer transistor 14 as part of a first voltage follower 130 and a second buffer transistor T3 as part of a second voltage follower 135 (first buffer transistor T4 and second buffer transistor T3 having the same noise spectral density, N). The first voltage follower 130 drives first shield 101 and first conductive surface 100 and the second voltage follower 135 drives the second shield 106 and the second conductive surface 105.

This approach actually increases the overall noise spectral density by factor of √2, but the effective capacitance value for the detection circuitry, $C_{det}$, is drastically reduced. By compensating for capacitances C2 and C3 and decreasing capacitance C6 to about ⅕ of the original value, the effective typical total capacitance becomes $$C'_{det} = C1 + 0.5*(C2 + C3 + C4 + C5 + C6)$$
$$= 5 + 0.5*(0 + 0 + 3 + 0 + 2) = 7.5 \text{ pF}.$$

As noted above, the noise spectral density for the pre-amplifier 120 is worsened by factor of √2, becoming equal to 2N nV/√Hz. Nevertheless, the S/N for this circuit becomes $$S/N' \sim 1/(7.5*2*N).$$

Comparing to $1/(C_{det}*\sqrt{2}*N)$ as given above for the embodiment of FIG. 2, an improvement of the S/N, G, is approximately $$G=(25.5*\sqrt{2})/(7.5*2)=2.4.$$

Hence, the reduction in capacitance causes an improvement in the S/N which is significantly greater than the reduction in S/N due to the increase in noise power spectral density of the pre-amplifier. However, further improvements are also possible, particularly within the pre-amplifier.

Figure 5:
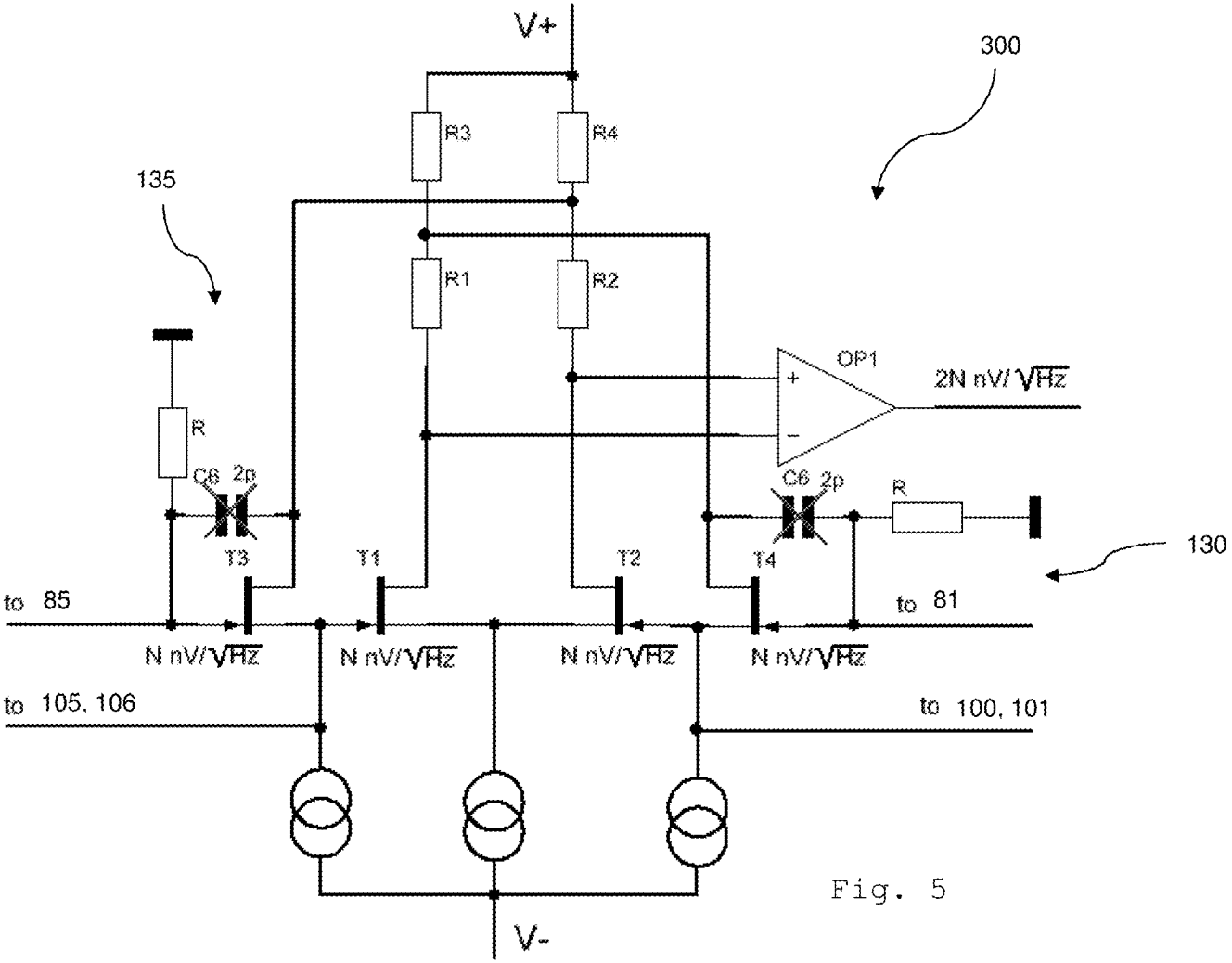
FIG. 5 illustrates a second embodiment of a pre-amplifier according to the present invention for use with the ion detection arrangement of FIG. 4.

Referring now to FIG. 5, there is shown a second embodiment of a pre-amplifier according to the present invention for use with the ion detection arrangement of FIG. 4. The pre-amplifier 300 is similar to the pre-amplifier 120 shown in FIG. 4. However, it also includes additional features to compensate for the input capacitance of the pre-amplifier.

A signal with the same amplitude and phase as the input signal to the preamplifier from first detection electrode 80 is connected to the drain of the FET transistor T4 that is part of the first voltage follower 130. Similarly, a signal with the same amplitude and phase as the input signal to the preamplifier from second detection electrode 85 is connected to the drain of the FET transistor T3 that is part of the second voltage follower 135. This means that all three terminals of the transistor for each voltage follower have the same AC voltage and virtually no input capacitance between the terminals.

This is achieved by taking the signal applied to the drain of the FET transistor T4 of the first voltage follower 130 from the drain of the second amplifier transistor T1 with an additional resistor, R4. Similarly, the signal applied to the drain of the FET transistor T3 of the second voltage follower 135 is taken from the drain of the first amplifier transistor T2 with an additional resistor, R3. The resistance values of R3 and R4 should be chosen from the equation $$R=2/Y_{fs},$$

where $Y_{fs}$ is the forward transfer admittance of a JFET transistor. A typical value for $C_{det}$ is now reduced from 7.5 pF to 6.5 pF, since C6 is effectively reduced to approximately zero. Then, the overall S/N improvement, G, in this case becomes $$G=(25.5*\sqrt{2})/(6.5*2)=2.77$$

The resistance values of R3 and R4 could be also chosen to differ from the equation above. For example, they could be chosen to over-compensate C6. However, over-compensation of the entire total capacitance of the detection circuit is not desirable, as it may lead to instability of the preamplifier.

Figure 6:
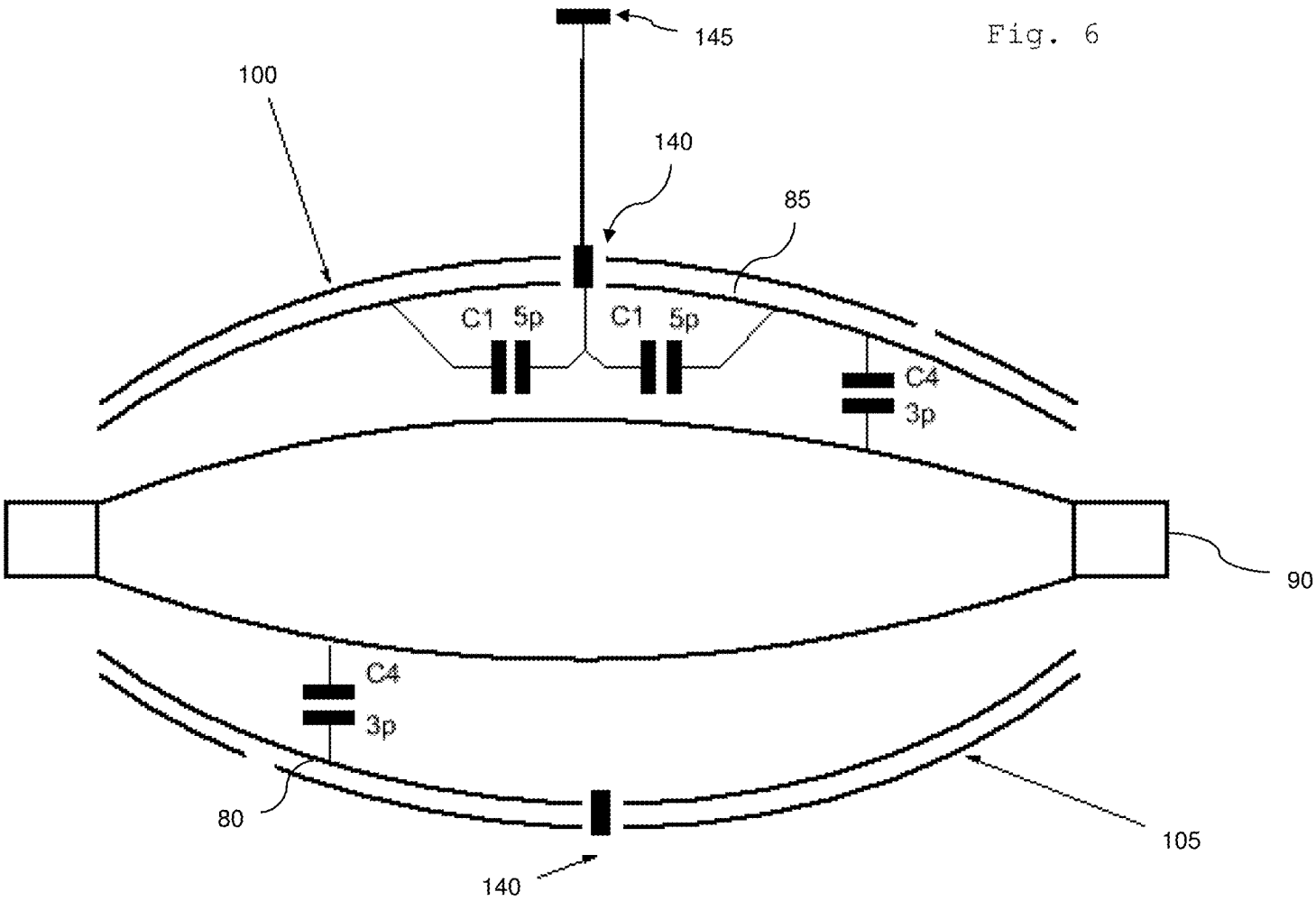
FIG. 6 depicts an electrostatic trap mass analyzer according to a third embodiment of the present invention.

Further reductions in capacitance can be achieved by means other than compensation. Referring next to FIG. 6, there is a shown an electrostatic trap mass analyzer according to a third embodiment of the present invention. This shows the electrostatic orbital trapping-type of the mass analyzer shown in FIGS. 1 to 4, but with an additional feature. A conductor, here formed as a metal ring 140, is installed between the first detector electrode 80 and the second detector electrode 85. The gap between the metal ring 140 to each of electrodes is the same and the metal ring 140 is connected to voltage supply 145. The voltage supply 145 is preferably external.

Typically, a few hundred volts are applied to the metal ring 140 in order to get the field inside the mass analyser correct. This voltage is desirably static during detection, but could be switchable at other times. Preferably, this voltage has a ripple below a few (1, 2 or 3) millivolts and preferably within a frequency range below 100 to 200 kHz. The voltage on the metal ring 140 is adjusted to provide optimum performance of the instrument, for example minimum transient decay for all m/z analysed.

This conductor splits the parasitic capacitance C1 into two parts with the same value and allows reduction of that capacitance by half. The voltage applied to this conductor, preferably from an external source, could be used to adjust ion frequencies as described in U.S. Pat. No. 7,399,962 FIG. 11 or U.S. Pat. No. 7,714,283 FIG. 5. This metal ring electrode 140 is used for fine optimisation of device performance, which is preferably carried out during the calibration process for different intensities of ions having different m/z ratios. The criteria for optimisation is to provide a uniform decay constant for ion transients of all intensities for a given m/z as well as monotonous dependence of this decay constant on m/z (preferably $(m/z)^{-1/2}$).

In this case, a typical value for $C_{det}$ is reduced to 4 pF the S/N is now proportional to $$S/N'' \propto 1/(4*2*N).$$

Then, the overall improvement in S/N becomes $$G=(25.5*\sqrt{2})/(4*2)=4.5.$$

Figure 7:
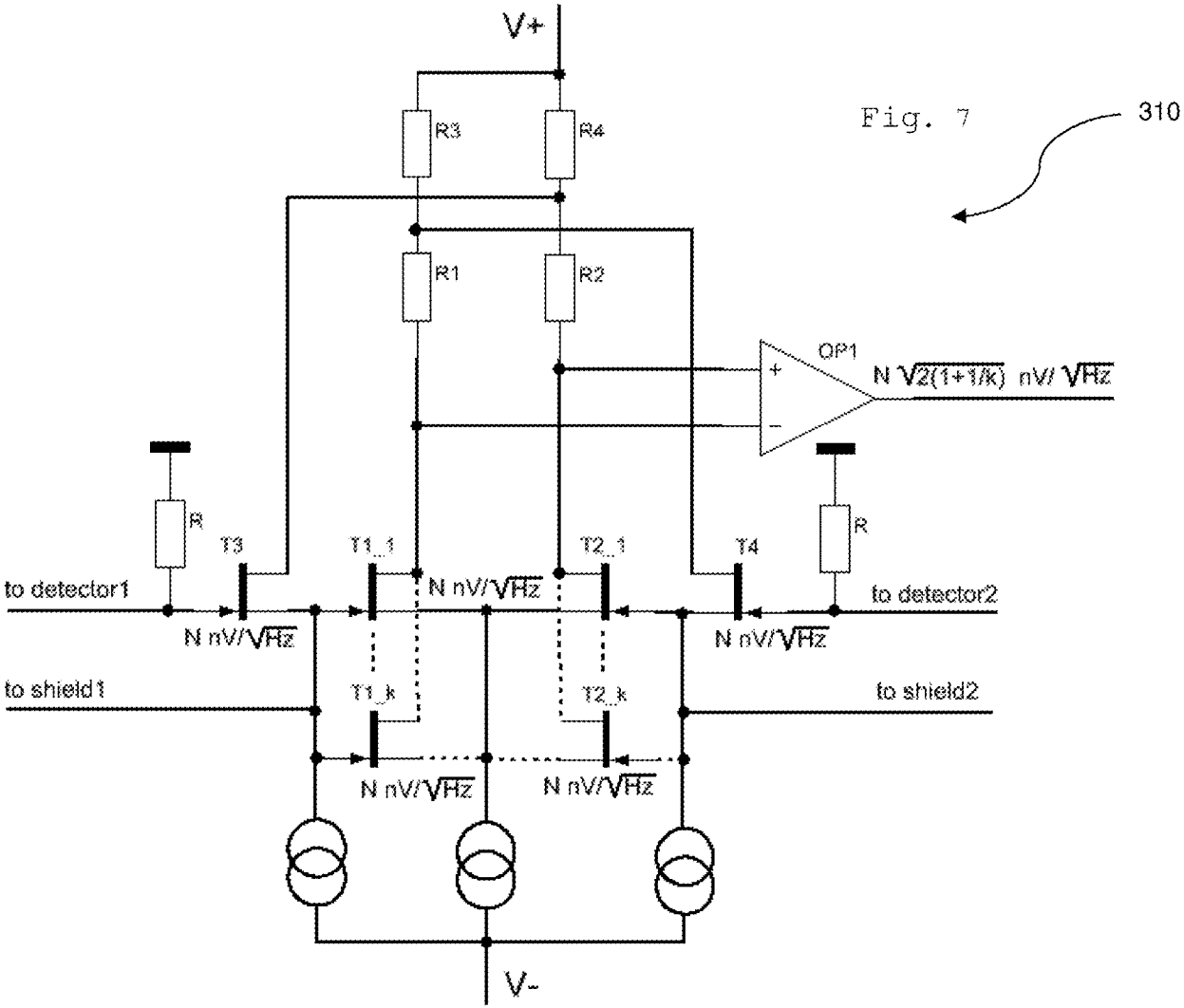
FIG. 7 shows a third embodiment of a pre-amplifier according to the present invention for use with the ion detection arrangement of FIG. 4.

Referring next to FIG. 7, there is shown a third embodiment of a pre-amplifier according to the present invention for use with the ion detection arrangement of FIG. 4. This pre-amplifier 310, includes all of the features shown in the pre-amplifier 300 of FIG. 5. However, it now includes an additional feature to improve further the S/N ratio. The first amplifier transistor T2 and second amplifier transistor T1 are formed from a set of transistors (normally substantially identical) connected in parallel. Where K such transistors are provided (K being an integer greater than 1), there are a plurality of first amplifier transistors T2_1 to T2_K and a plurality of second amplifier transistors T1_1 to T1_K.

This approach reduces overall spectral noise density of the pre-amplifier by factor in the range 2N to √2N. For K such pairs of transistors in parallel, the overall noise spectral density of the Pre-amplifier with the buffer stage become equal to $N^{*}[2(1+1/K)]^{1/2}$.

In practice, there may be difficulties in driving more then 3 or 4 paralleled transistors by a single voltage buffer formed of a single JFET, because the input capacitance of paralleled transistors becomes too high. The table below provides estimates of the S/N improvement in circuits with up to four transistors in each side of the differential stage relative to the design shown in FIG. 2. The improvements shown in FIGS. 3 to 6 are also taken into account.

| Transistor count, K | 1 | 2 | 3 | 4 |
|---|---|---|---|---|
| Overall noise spectral density | 2N | 1.73N | 1.63N | 1.58N |
| Overall S/N improvement | 4.5 | 5.2 | 5.5 | 5.7 |

All numbers shown in the table for overall S/N improvements may be considered absolute upper limits for a simplified analysis of the image current detection system. In practice, the S/N improvement may be lower and depend on the type of input transistors and the depth of capacitive feedback created by the compensation signal at the input buffer stage of the amplifier.

Figure 8:
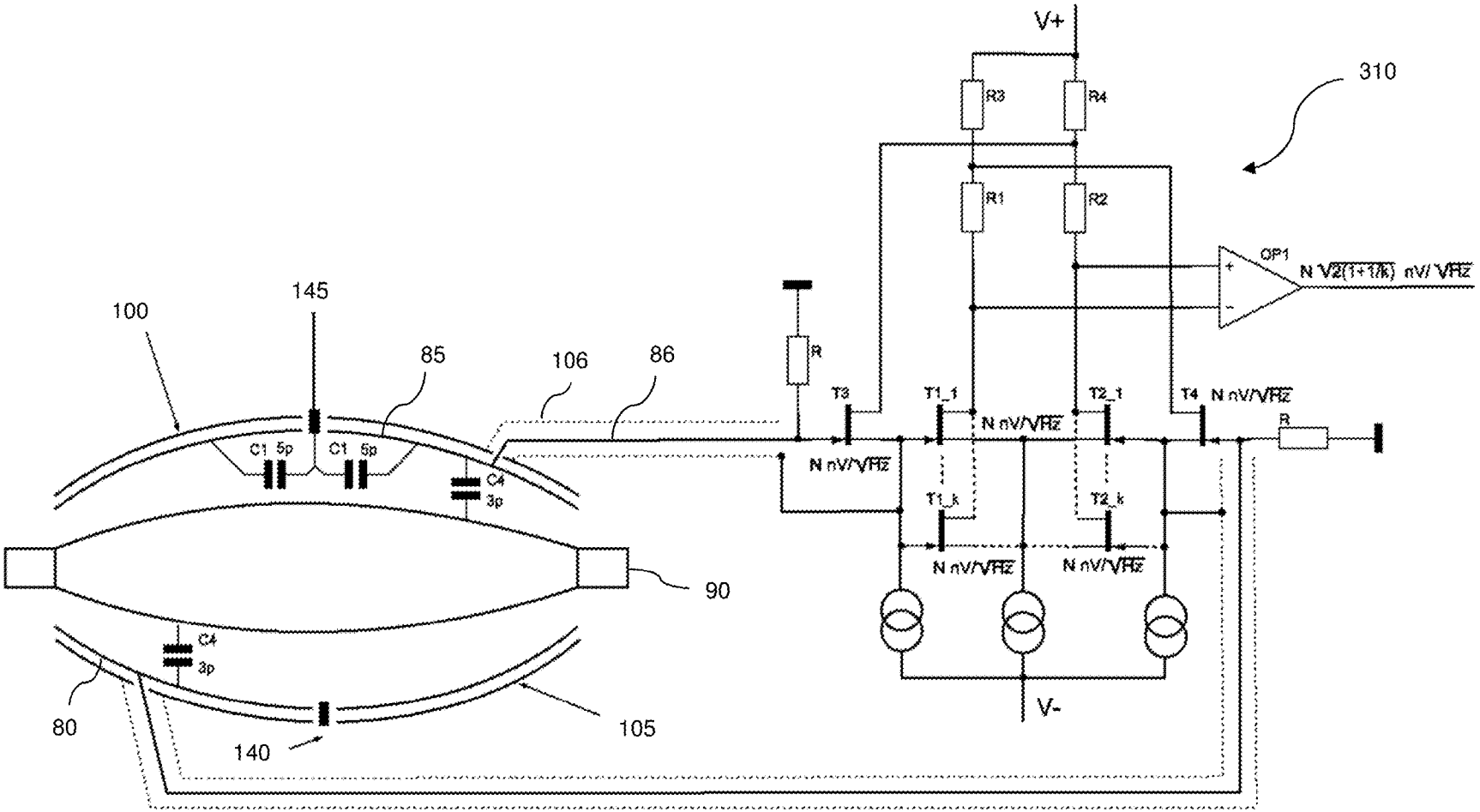
FIG. 8 illustrates an ion detection arrangement incorporating the electrostatic trap mass analyzer of FIG. 6 and the third embodiment of the pre-amplifier of FIG. 7.

Referring now to FIG. 8, there is shown an ion detection arrangement incorporating the electrostatic trap mass analyzer of FIG. 6 and the third embodiment of the pre-amplifier of FIG. 7. Also shown are any remaining parasitic capacitances and resistances for comparison with those shown in FIG. 2.

The parasitic capacitance C4 is determined by the physical design of the electrostatic orbital trapping-type mass analyzer. In principle, the parasitic capacitance C4 could be reduced in a similar way to the approach taken by the embodiment shown in FIG. 6, by splitting the central electrode 90 in two and feeding active compensation to each half via a decoupling high-voltage capacitance. This could be undertaken independently from the other measures taken. However, the gain from this measure is not likely to be substantial and therefore does not justify a considerable increase in complexity and cost. Moreover, C4 represents the smallest parasitic capacitance to affect the signal intensity and the most difficult to compensate due to high voltages applied to the central electrode 90 (which may typically reach 5 kV).

Altogether, active compensation allows in principle to reduce typical effective capacitance ($C_{det}$) from about 24 pF to about 5 or 6 pF, as explained above. In addition, the compensation approach taken is expected to allow additional freedom of design. For example: the walls of the mass spectrometer chamber could come now much closer to the mass analyser assembly; and the wires to the pre-amplifier could be made longer (if necessary). Most importantly, the shields 101 and 106 and conductive surfaces 100 and 105 used for active compensation are also shielding detection electrodes 80 and 85 from other sources of noise, especially from ground loops. Further S/N improvement to that suggested above may therefore be possible.

Figure 9:
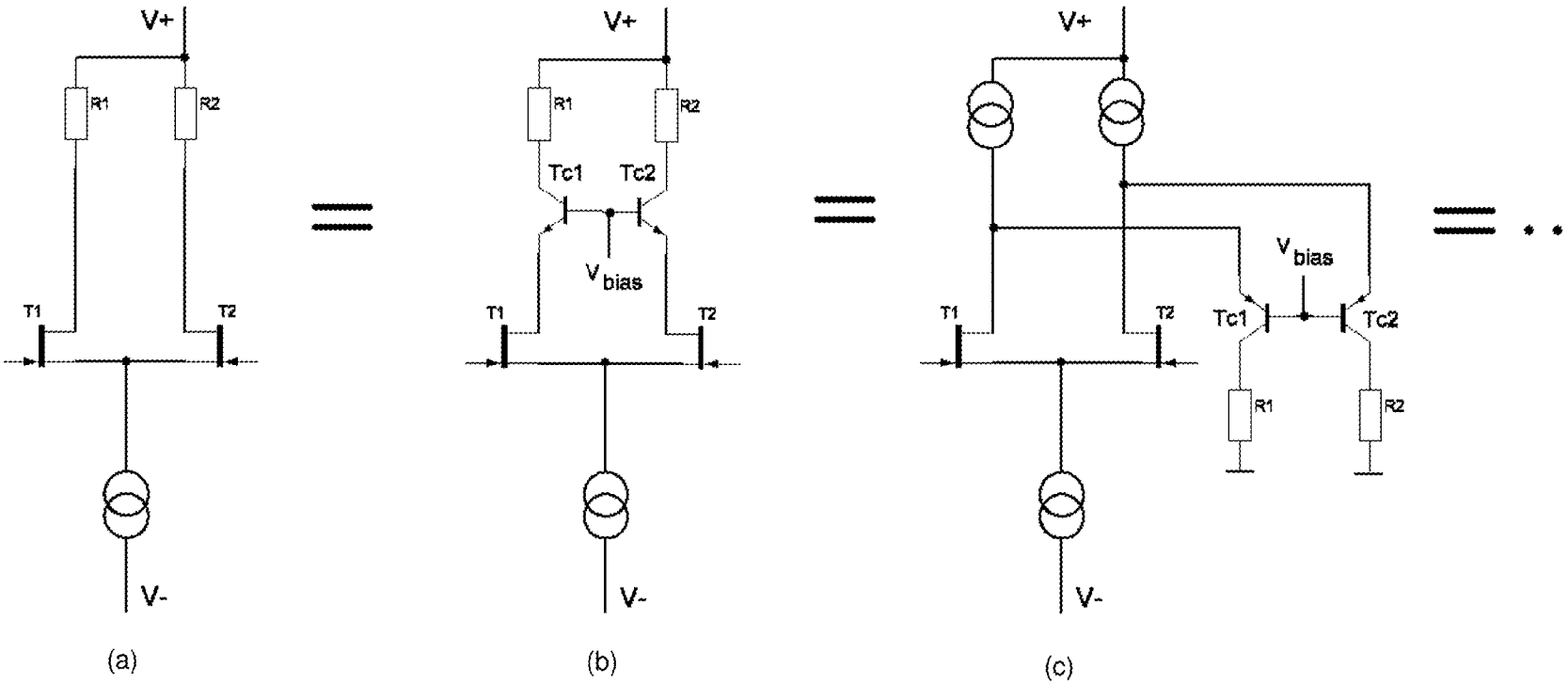
FIG. 9 illustrates variants of design solutions for the differential input stage of FIGS. 7 and 8.

Referring next to FIG. 9, there is shown variants of design solutions for the differential input stage of FIGS. 7 and 8. The input differential stage shown could be any known circuit that comprises some cascode combination of the transistors or any other known circuit solutions providing the same effect as shown in FIG. 9.

Transistors on that stage could be any low noise types like JFET, MOSFET or BJT npn/pnp. The $V_{bias}$ voltage could be a constant potential or a voltage that follows the input common mode signal. Input buffer transistors T3 and T4 of FIGS. 7 and 8 allow a reduction in the overall noise density by using transistors with very low spectral noise density. Normally such ultra-low noise transistors have quite a large input capacitance, for example IF3601 (manufactured by InterFet Corp.) has noise spectral density of 0.3 nV/√Hz and 300 pF input capacitance and for the IF9030, these figures are 0.5 nV/√Hz and 60 pF.

The input buffer with a common drain (collector) topology shown in FIGS. 7 and 8 cancels its input capacitance and thus opens a possibility to drive paralleled transistors with large input capacitance. This technique could provide good improvement of the preamplifier noise spectral density (up to factor of 2) compared with the preamplifier employing a conventional low capacitance JFET such as BF862 (manufactured by NXP Semiconductor with noise spectral density of 0.8 nV/√Hz and input capacitance of 10 pF) in a differential stage without the input buffer.

Whilst specific embodiments have been described herein, the skilled person may contemplate various modifications and substitutions.

For example, this invention could be applied to all types of FT-ICR instruments, RF ion traps and electrostatic traps, including instruments with multiple detection electrodes, for both odd and even numbers of such electrodes.

This invention could be also used for active compensation of effects related to space charge. For example at large ion numbers, the oscillation frequency of the ions shifts in any trap. This is to a large extent caused by the image charges induced in all electrodes by moving ions. If the voltage induced on some of the electrodes is modulated in-phase or out of phase with the signal, this effect could be cancelled out and traps could be made more tolerant to high space charge. This in turn improves mass accuracy and dynamic range of analysis.

One of the ways to achieve this is to apply to the metal ring 140 not only a compensating DC voltage but also an AC signal. Preferably, the AC voltage is derived from both detected signals, for example their difference scaled with a certain coefficient. The DC voltage also could be corrected dependent on the signal, such as to compensate for change of frequency caused by space charge. This may improve mass accuracy. Other electrodes could be used to the same effect, including the detection electrodes themselves.

As an example, the DC voltage on all outer electrodes could be biased by a voltage that compensates the drop of the axial frequency caused by space charge. The expected space charge could be estimated from the ion number requested to be injected into the analyzer or directly from the first milliseconds of the transient signal. The compensation voltage could then be ramped slowly to the required level so that the frequency shift over the entire transient is nullified.

In another example, additional segments could be formed near a central part of the central electrode so that ions pass near these additional segments, but such that these segments are too far from the detection electrodes to cause significant coupling of an AC signal into the latter. If an AC signal is formed from the detected signal and it is then applied in-phase to these segments, this would cause attraction of ions to the segments. By adjusting the amplitude of the AC signal using an additional amplifier, it would be possible to cause an attractive force that completely compensates for the attraction from mirror charges formed in the detection electrodes. As a result, the frequency of oscillations will not depend on space charge, both overall for the entire beam and locally for a particular m/z or limited m/z range.

The skilled person will appreciate that different types of transistors can be used in conjunction with this invention. Some transistors may have a lower noise level but higher capacitance than other transistors. In such cases, the total noise at the output of the preamplifier would still be reduced when these transistors are used with this invention. This is in view of the reduction in $C_{det}$ due to other sources, as explained above.

The invention claimed is:

1. An electrostatic ion trapping device comprising:

a trapping field generator, configured to provide a trapping field defining an ion trapping volume, in which ions are confined;

a detection arrangement, configured to detect an image current from ions trapped in the ion trapping volume, using a plurality of detection electrodes;

a shielding conductor, positioned between a first detection electrode and a second detection electrode from the plurality of detection electrodes; and a controller, configured to apply a voltage to the shielding conductor based on an image current detected by at least one of the plurality of detection electrodes.

2. The electrostatic ion trapping device of claim 1, wherein a signal-carrying part of the detection arrangement comprises a detection electrode from the plurality of detection electrodes and a respective compensatory part of the detection arrangement comprises a shield for the detection electrode.

3. The electrostatic ion trapping device of claim 2, wherein the shield for the detection electrode comprises a conductive surface around the detection electrode, insulated from the detection electrode.

4. The electrostatic ion trapping device of claim 3, wherein the shield for the detection electrode is made from a dielectric material with a metallised outer coating, the metallised outer coating being configured to receive the compensation signal.

5. The electrostatic ion trapping device of claim 1, wherein a signal-carrying part of the detection arrangement comprises a connection between a detection electrode from the plurality of detection electrodes and a preamplifier and a respective compensatory part of the detection arrangement comprises a shield for the connection.

6. The electrostatic ion trapping device of claim 1, wherein the controller is configured to provide a first shield compensation signal to a first shield compensatory part of the detection arrangement, and a second shield compensation signal to a second shield compensatory part of the detection arrangement, the first shield compensation signal and the second shield compensation signal being the same.

7. The electrostatic ion trapping device of claim 6, wherein the first shield compensatory part comprises a shield for a first detection electrode from the plurality of detection electrodes and wherein the second shield compensatory part comprises a shield for a connection between the first detection electrode and a preamplifier.

8. A method of electrostatic ion trapping comprising:

causing ions to be trapped in an ion trapping volume;

detecting an image current from ions trapped in the ion trapping volume using a plurality of detection electrodes;

providing a shielding conductor, positioned between a first detection electrode and a second detection electrode from the plurality of detection electrodes; and applying a voltage to the shielding conductor based on an image current detected by at least one of the plurality of detection electrodes.

* * * * *